US010482803B2

(12) United States Patent
Kim et al.

(10) Patent No.: US 10,482,803 B2
(45) Date of Patent: Nov. 19, 2019

(54) DISPLAY DRIVER INTEGRATED CIRCUIT

(71) Applicant: Samsung Electronics Co., Ltd., Suwon-si, Gyeonggi-do (KR)

(72) Inventors: Jeehwal Kim, Seoul (KR); Yanghyo Kim, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 216 days.

(21) Appl. No.: 14/990,080

(22) Filed: Jan. 7, 2016

(65) Prior Publication Data

US 2016/0343293 A1 Nov. 24, 2016

(30) Foreign Application Priority Data

May 20, 2015 (KR) ..... 10-2015-0070437

(51) Int. Cl.
*G09G 3/20* (2006.01)

(52) U.S. Cl.
CPC ..... *G09G 3/20* (2013.01); *G09G 2310/0275* (2013.01); *G09G 2330/028* (2013.01)

(58) Field of Classification Search
None
See application file for complete search history.

(56) References Cited

U.S. PATENT DOCUMENTS 7,062,663 B2 6/2006 Meynard
2001/0028338 A1 10/2001 Kayamori et al.
2002/0000969 A1* 1/2002 Ozawa ..... G09G 3/3688 345/100
2002/0126107 A1* 9/2002 Inoue ..... G09G 3/367 345/204
2004/0036670 A1* 2/2004 Chung ..... G09G 3/3688 345/99
2005/0052890 A1* 3/2005 Morita ..... G09G 3/3688 365/87
2010/0201698 A1 8/2010 Lee
2011/0043505 A1 2/2011 Ahn et al.
2012/0133631 A1* 5/2012 Lim ..... G09G 3/3688 345/211
2015/0130851 A1* 5/2015 Jeong ..... G09G 3/20 345/690
2016/0035301 A1* 2/2016 Neugebauer ..... G09G 3/3648 345/100

FOREIGN PATENT DOCUMENTS

KR 100646997 B1 11/2006
KR 20100091481 A 8/2010

* cited by examiner

*Primary Examiner* — Nitin Patel
*Assistant Examiner* — Amen Woldesenbet Bogale
(74) *Attorney, Agent, or Firm* — Harness, Dickey & Pierce, P.L.C.

(57) ABSTRACT

A display driver integrated circuit is provided. The display driver integrated circuit includes a source driver configured to receive a power voltage from a power management integrated circuit and a logic circuit configured to control the power management integrated circuit. Display data or a command from an application processor is received, and the display data or the command is analyzed. A voltage level of the power voltage is controlled based on the analysis.

9 Claims, 13 Drawing Sheets

| MODE | Sum(S) | Vp |
|---|---|---|
| Mode1 | S < 3X1600X5/20 | 6.80 V |
| Mode2 | 3X1600X5/20 ≤ S < 3X1600X6/20 | 6.85 V |
| Mode3 | 3X1600X6/20 ≤ S < 3X1600X7/20 | 6.90 V |
| Mode4 | 3X1600X7/20 ≤ S < 3X1600X8/20 | 6.95 V |
| Mode5 | 3X1600X8/20 ≤ S < 3X1600X9/20 | 7.00 V |
| Mode6 | 3X1600X9/20 ≤ S < 3X1600X10/20 | 7.05 V |
| Mode7 | 3X1600X10/20 ≤ S < 3X1600X11/20 | 7.10 V |
| Mode8 | 3X1600X11/20 ≤ S < 3X1600X12/20 | 7.15 V |
| Mode9 | 3X1600X12/20 ≤ S < 3X1600X13/20 | 7.20 V |
| Mode10 | 3X1600X13/20 ≤ S < 3X1600X14/20 | 7.25 V |
| Mode11 | 3X1600X14/20 ≤ S < 3X1600X15/20 | 7.30 V |
| Mode12 | S ≥ 3X1600X15/20 | 7.35 V |

FIG. 3

| MODE | Sum(S) | Vp |
|---|---|---|
| Mode1 | S < 3X1600X5/20 | 6.80 V |
| Mode2 | 3X1600X5/20 ≤ S < 3X1600X6/20 | 6.85 V |
| Mode3 | 3X1600X6/20 ≤ S < 3X1600X7/20 | 6.90 V |
| Mode4 | 3X1600X7/20 ≤ S < 3X1600X8/20 | 6.95 V |
| Mode5 | 3X1600X8/20 ≤ S < 3X1600X9/20 | 7.00 V |
| Mode6 | 3X1600X9/20 ≤ S < 3X1600X10/20 | 7.05 V |
| Mode7 | 3X1600X10/20 ≤ S < 3X1600X11/20 | 7.10 V |
| Mode8 | 3X1600X11/20 ≤ S < 3X1600X12/20 | 7.15 V |
| Mode9 | 3X1600X12/20 ≤ S < 3X1600X13/20 | 7.20 V |
| Mode10 | 3X1600X13/20 ≤ S < 3X1600X14/20 | 7.25 V |
| Mode11 | 3X1600X14/20 ≤ S < 3X1600X15/20 | 7.30 V |
| Mode12 | S ≥ 3X1600X15/20 | 7.35 V |

51

52

DISPLAY DRIVER INTEGRATED CIRCUIT

CROSS-REFERENCE TO RELATED APPLICATION

This application claims priority under 35 U.S.C. § 119 to Korean Patent Application No, 10-2015-0070437 filed on May 20, 2015, the entire contents of which are incorporated herein by reference in their entirety.

BACKGROUND

Field

Embodiments of the inventive concepts relate to a display driver integrated circuit.

Description of Related Art

A display driver integrated circuit (DDI) may include a plurality of source drivers for driving each of a plurality of pixels. The power management integrated circuit (PMIC) may supply an input voltage Vin to each of the plurality of source drivers. The maximum output of the source driver may be defined as Vo.

Generally, the maximum output voltage Vo of the source driver may be determined by a customer. For example, the customer may be a mobile set maker.

$$V_{DDI}-Vo>Vhr \quad \text{[Expression 1]}$$

Here, $V_{DDI}$ denotes a power voltage of a DDI, Vo denotes an output voltage of a source driver, and Vhr denotes voltage headroom.

In Expression 1, the voltage headroom Vhr may be set to ensure characteristics, such as noise, a slew rate, etc., or to maintain a voltage difference between the power voltage $V_{DDI}$ of the DDI and a maximum output voltage Vo of the source driver.

The voltage headroom Vhr may be set according to the worst case in a related art. That is, the power voltage of the DDI $V_{DDI}$ may be maximally set in consideration of the worst case. Accordingly, a current consumption of the DDI according to the related art may be increased. For example, the worst case may be playing a video having the highest luminance at a high temperature.

SUMMARY

Embodiments of the inventive concepts provide a display driver integrated circuit (DDI) that controls a power management integrated circuit (PMIC) to change a power voltage by predicting or measuring an amount of current consumption.

In accordance with one aspect of the inventive concepts, a display driver integrated circuit includes a source driver configured to receive a power voltage from a power management integrated circuit and a logic circuit configured to control the power management integrated circuit so that display data or a command from an application processor is received, the display data or the command is analyzed, and a voltage level of the power voltage is controlled based on the analysis.

In an embodiment, the logic circuit may analyze the display data and predict an amount of current consumption according to the display data.

In another embodiment, the display data may include image data in unit of frames, the image data in unit of frames comprises a plurality of horizontal lines, each of the plurality of horizontal lines may include a plurality of pixel bits, and the logic circuit may control the power management integrated circuit so that each pixel bit of a first horizontal line is compared with each pixel bit of a second horizontal adjacent to the first horizontal line, the compared results are summed, and a voltage level of the power voltage is controlled based on the summed results.

In still another embodiment, the logic circuit may control the power management integrated circuit to lower the voltage level of the power voltage when the summed results are less than a reference value, and the logic circuit may control the power management integrated circuit to maintain the voltage level of the power voltage when the summed results are greater than or equal to the reference value.

In yet another embodiment, the logic circuit may extract information about the display mode from the command and predict an amount of current consumption according to the display mode.

In yet another embodiment, the display mode may include a first mode configured to drive an entire area of a display panel and a second mode configured to drive a portion of the display panel.

In yet another embodiment, the logic circuit may control the power management integrated circuit to maintain a voltage level of the power voltage as it is, when the command includes the first mode.

In yet another embodiment, the logic circuit may control the power management integrated circuit to lower the voltage level of the power voltage as it is when the command includes the second mode.

In yet another embodiment, the second mode may include a mode for driving only an edge area of the display panel.

In yet another embodiment, the display driver integrated circuit may further include an interface circuit and the logic circuit may transmit a control signal to the power management integrated circuit through the interface circuit.

In accordance with another aspect of the inventive concepts, a display driver integrated circuit includes a source driver configured to receive a power voltage from a power management integrated circuit and a logic circuit configured to control the source driver. The source driver includes a worst point where a greatest voltage drop of the power voltage occurs, and a voltage signal of the worst point is transmitted to the power management integrated circuit.

In an embodiment, the power management integrated circuit may apply the power voltage corresponding to the voltage signal of the worst point to the display driver integrated circuit.

In another embodiment, the power management integrated circuit may include an analog feedback loop to control an output voltage using an input voltage.

In still another embodiment, the source driver may include a plurality of amplifiers and a resistor string. Each of the plurality of amplifiers may receive the power voltage through the resistor string, and the resistor string may include the worst point.

In yet another embodiment, a position of the worst point may be determined through a simulation.

In accordance with another aspect of the inventive concepts, a display driver integrated circuit includes a source driver configured to receive a power voltage from a power management integrated circuit and including a worst point where a greatest voltage drop of the power voltage occurs, an analog-to-digital converter configured to receive a voltage signal from the worst point and to convert the voltage signal into a digital value, and a logic circuit configured to receive the digital value from the analog-to-digital converter and to transmit a control signal corresponding to the converted digital value to the power management integrated circuit.

In an embodiment, the power management integrated circuit may control a voltage level of the power voltage in response to the control signal.

In another embodiment, the source driver may include a plurality of amplifiers and a resistor string, each of the plurality of amplifiers may receive the power voltage through the resistor string, and the resistor string includes the worst point.

In still another embodiment, the display driver integrated circuit may further include an interface circuit and the logic circuit may transmit the control signal to the power management integrated circuit through the interface circuit.

In yet another embodiment, a position of the worst point may be determined through a simulation.

BRIEF DESCRIPTION OF THE DRAWINGS

The foregoing and other features and advantages of the inventive concepts will be apparent from the more particular description of example embodiments of the inventive concepts, as illustrated in the accompanying drawings in which like reference characters refer to the same parts throughout the different views. The drawings are not necessarily to scale, emphasis instead being placed upon illustrating the principles of the inventive concepts. In the drawings:

FIG. 3 is a table according to an operation of the DDI shown in FIG. 1;

DETAILED DESCRIPTION OF THE EMBODIMENTS

Figure 1:
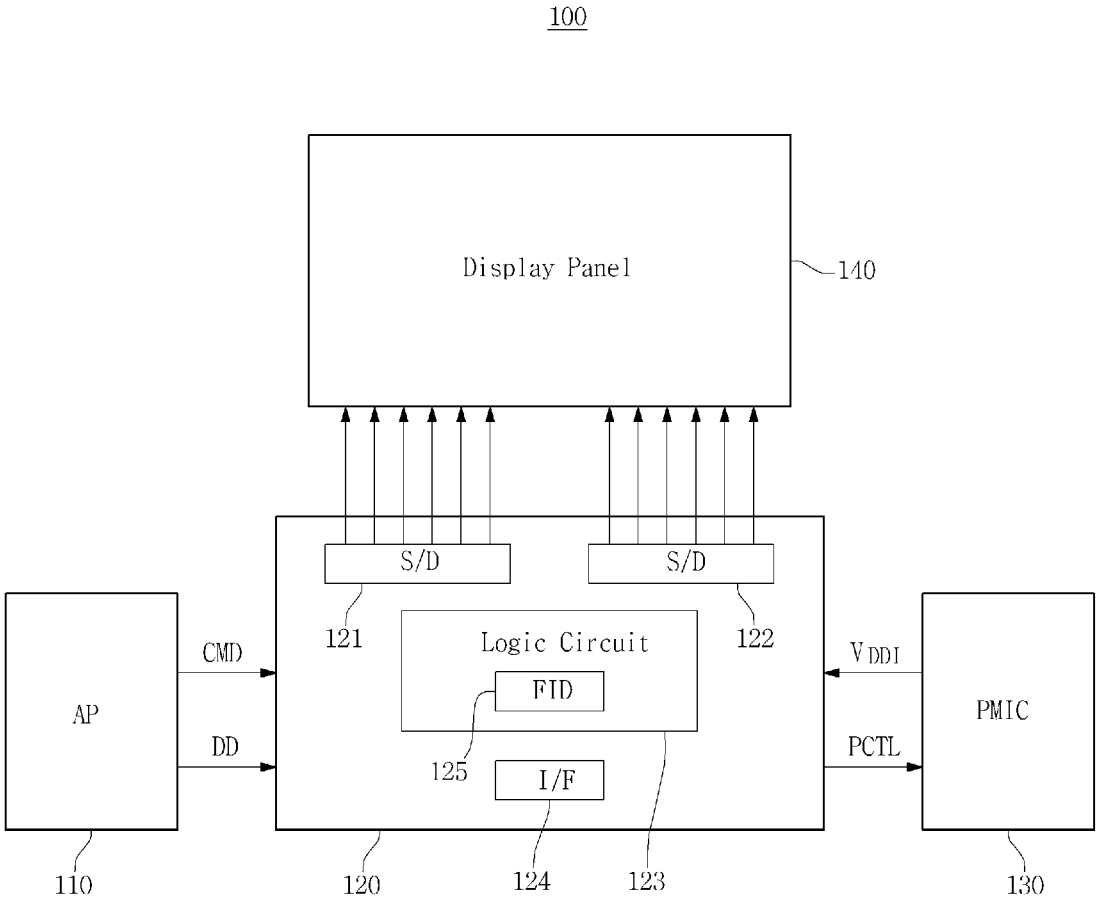
FIG. 1 is a block diagram illustrating a mobile device according to a first embodiment of the inventive concepts.

Example embodiments of the present disclosure are described below in sufficient detail to enable those of ordinary skill in the art to embody and practice the present disclosure. It is important to understand that the present disclosure may be embodied in many alternate forms and should not be construed as limited to the example embodiments set forth herein.

While the present disclosure is susceptible to various modifications and alternative forms, specific embodiments thereof are shown by way of example in the drawings and will herein be described in detail. It should be understood, however, that there is no intent to limit the present disclosure to the particular forms disclosed, but on the contrary, the present disclosure is to cover all modifications, equivalents, and alternatives falling within the spirit and scope of the present disclosure.

It will be understood that, although the terms "first," "second," "A," "B," etc. may be used herein in reference to elements of the present disclosure, such elements should not be construed as being limited by these terms. For example, a first element could be termed a second element, and a second element could be termed a first element, without departing from the scope of the present disclosure. Herein, the term "and/or" includes any and all combinations of one or more referents.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements. Other words used to describe relationships between elements should be interpreted in a like fashion (i.e., "between" versus "directly between," "adjacent" versus "directly adjacent," etc.).

The terminology used herein to describe embodiments of the present disclosure is not intended to limit the scope of the present disclosure. The articles "a," "an," and "the" are singular in that they have a single referent, however the use of the singular form in the present document should not preclude the presence of more than one referent. In other words, elements of the present disclosure referred to as in singular may number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art to which the present disclosure belongs. It will be further understood that terms in common usage should also be interpreted as is customary in the relevant art and not in an idealized or overly formal sense unless expressly so defined herein.

Meanwhile, when it is possible to implement any embodiment in any other way, a function or an operation specified in a specific block may be performed differently from a flow specified in a flowchart. For example, consecutive two blocks may actually perform the function or the operation simultaneously, and the two blocks may perform the function or the operation conversely according to a related operation or function.

Embodiments of the present inventive concepts will be described below with reference to attached drawings.

A display driver integrated circuit (DDI) may dynamically reduce a current consumption of the DDI. For example, the DDI may control a power management integrated circuit (PMIC) to change a power voltage by determining a display mode or analyzing display data to predict a current consumption. Moreover, the DDI may control the PMIC to change a power voltage using a current corresponding to the worst point in a source driver.

Further, the DDI may include an analog-to-digital converter (ADC). The ADC may receive the current corresponding to the worst point. The ADC may transmit a digital value corresponding to the current to the PMIC. The PMIC may apply a power voltage corresponding to the digital value. Therefore, the DDI may predict and measure a current consumption to reduce a power consumption.

Each of first to fourth embodiments discloses a method of controlling a power voltage Vp input from the PMIC to the DDI. In detail, the first and second embodiments disclose a method of controlling a power voltage Vp input from the PMIC to the DDI by predicting a current. The third and fourth embodiments disclose a method of controlling a power voltage Vp input from the PMIC to the DDI by measuring a current.

Further, each of fifth to seventh embodiments discloses a method of controlling a power voltage RVDD supplied to a logic circuit in a DDI. In detail, the fifth embodiment discloses a method of controlling a regulator voltage Vreg supplied to a logic circuit by predicting a current. The sixth and seventh embodiments disclose a method of controlling a regulator voltage Vreg supplied to a logic circuit by measuring a current.

FIG. 1 is a block diagram illustrating a mobile device according to the first embodiment of the inventive concepts. Referring to FIG. 1, the mobile device 100 according to the first embodiment of the inventive concepts may include an application processor (AP) 110, a DDI 120, a PMIC 130, and a display panel 140.

The AP 110 may transmit a command CMD and display data DD to the DDI 120. The command CMD may include information about a display mode. The display data DD may include data to be displayed in the display panel 140.

The DDI 120 according to the embodiment of the inventive concepts may include a plurality of source drivers 121 and 122, a logic circuit 123, and an interface circuit 124.

Each of the plurality of source drivers 121 and 122 may apply a grey voltage corresponding to the display data DD to the display panel 140. The display panel 140 may display an image corresponding to the display data DD.

The DDI 120 may receive the display data DD from the AP 110 through the interface circuit 124. The DDI 120 may further include a graphic memory device (not shown) for storing the display data DD.

The logic circuit 123 may include a frame image decision unit (FID) 125 for analyzing the display data DD from the AP 110. To reduce a power consumption, the FID 125 according to the embodiment of the inventive concepts may determine image data to be displayed by analyzing the display data DD.

For example, when the display data DD corresponds to a still image having only one color, a power consumption of the DDI 120 may be low. Accordingly, the logic circuit 23 may control the PMIC 130 to lower a voltage level of the power voltage $V_{DDI}$.

On the other hand, the FID 125 may analyze the display data DD. When the display data DD corresponds to a still image having a number of colors or a video, a power consumption of the DDI 120 may be high. Accordingly, the logic circuit 123 may control the PMIC 130 to maintain a voltage level of the power voltage $V_{DDI}$ as it is. That is, the logic circuit 123 may generate a PMIC control signal PCTL for controlling a power voltage $V_{DDI}$ of the PMIC 130. The logic circuit 123 may transmit the PMIC control signal PCTL to the PMIC 130 through the interface circuit 124.

In response to the PMIC control signal PCTL, the PMIC 130 may supply the power voltage $V_{DDI}$ to the DDI 120. The FID 125 according to the embodiment of the inventive concepts may be described with reference to FIGS. 2 and 3 in detail.

Figure 2:
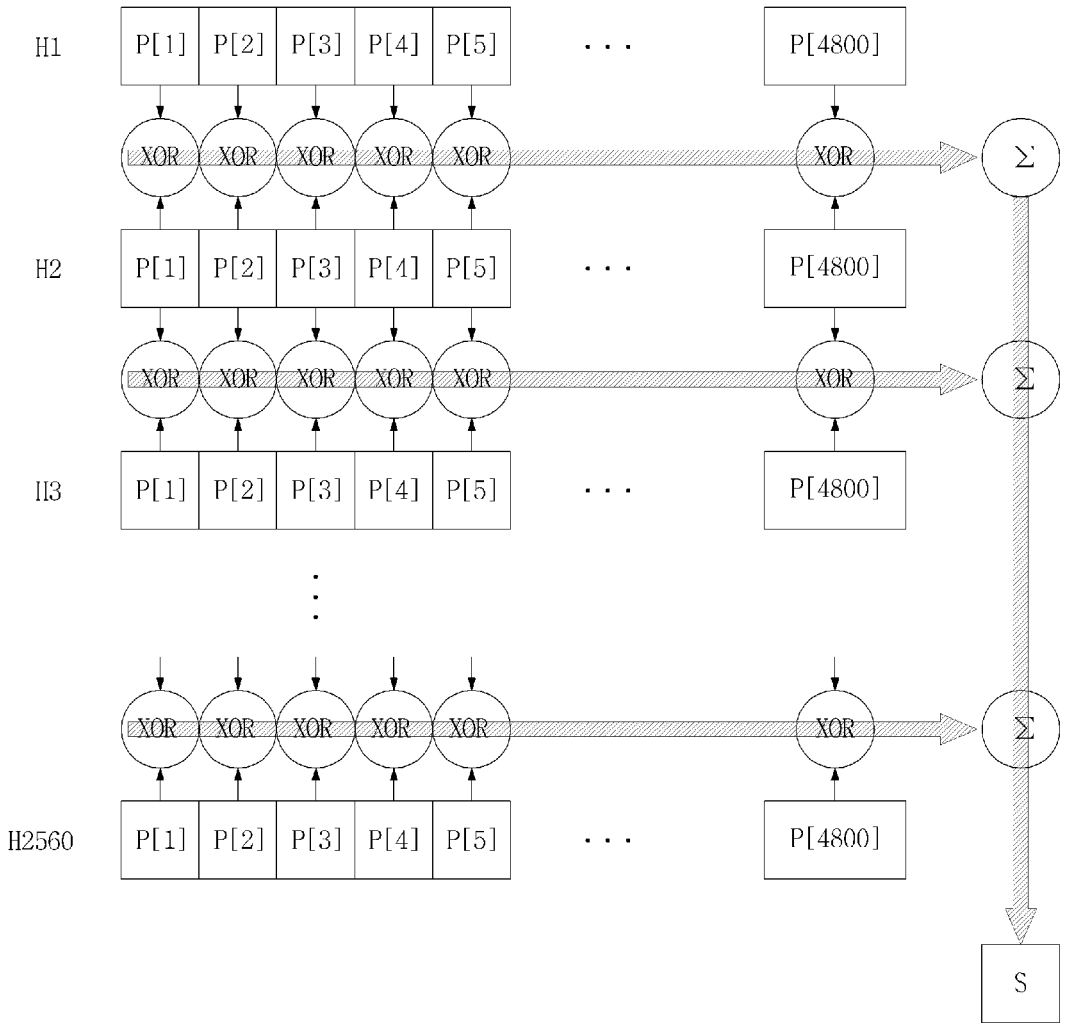
FIG. 2 is a concepts diagram for describing an operation of a display driver integrated circuit shown in FIG. 1.

FIG. 2 is a concepts diagram for describing an operation of the DDI shown in FIG. 1. Referring to FIGS. 1 and 2, the display data DD may include image data in units of frames. The image data may include a plurality of horizontal lines in one frame.

For example, when the DDI 120 supports a wide quarter video graphics array (WQVGA) resolution (e.g., 2560×1600), the display data DD may include first to $2560^{th}$ horizontal lines H1 to H2560. The FID 125 may compare the first horizontal line H1 with the second horizontal line 1-12. That is, the FID 125 may compare each of bits in the first horizontal line H1 with each of bits in the second horizontal line H2, and may count the compared results.

Similar to the above, the FID 125 may compare each of bits in the second horizontal line 112 with each of bits in the third horizontal line 1-13, and may count the compared results. Finally, the FID 125 may compare each of bits in the $2559^{th}$ horizontal line H2559 with each of bits in the $2560^{th}$ horizontal line H2560, and may count the compared results.

The FID 125 may sum all of the counted results. The FID 125 may compare the summed result S with a reference value, and may set the power voltage $V_{DDI}$.

FIG. 3 is a table according to an operation of the DDI shown in FIG. 1. Referring to FIGS. 1 to 3, the FID 125 may sum all of the counted results. The FID 125 may compare the summed result S with a reference value, and may set the power voltage $V_{DDI}$. For example, when the summed result S is less than a first reference value (e.g., 3×1600×5/20), the PMIC control signal PCTL may correspond to the first mode mode1.

The logic circuit 123 may transmit the PMIC control signal PCTL corresponding to the first mode mode1 to the PMIC 130 via the interface circuit 124. The PMIC 130 may apply the power voltage $V_{DDI}$ of 6.8 V to the DDI 120.

Similar to the above, when the summed result S is greater than or equal to a first reference value (e.g., 3×1600×5/20), and less than a second reference value (e.g., 3×1600×6/20), the PMIC control signal PCTL may correspond to the second mode mode2.

The logic circuit 123 may transmit the PMIC control signal PCTL corresponding to the second mode mode2 to the PMIC 130 via the interface circuit 124. The PMIC 130 may apply the power voltage $V_{DDI}$ of 6.85 V to the DDI 120. Accordingly, the DDI 120 may reduce a total power consumption.

Figure 4:
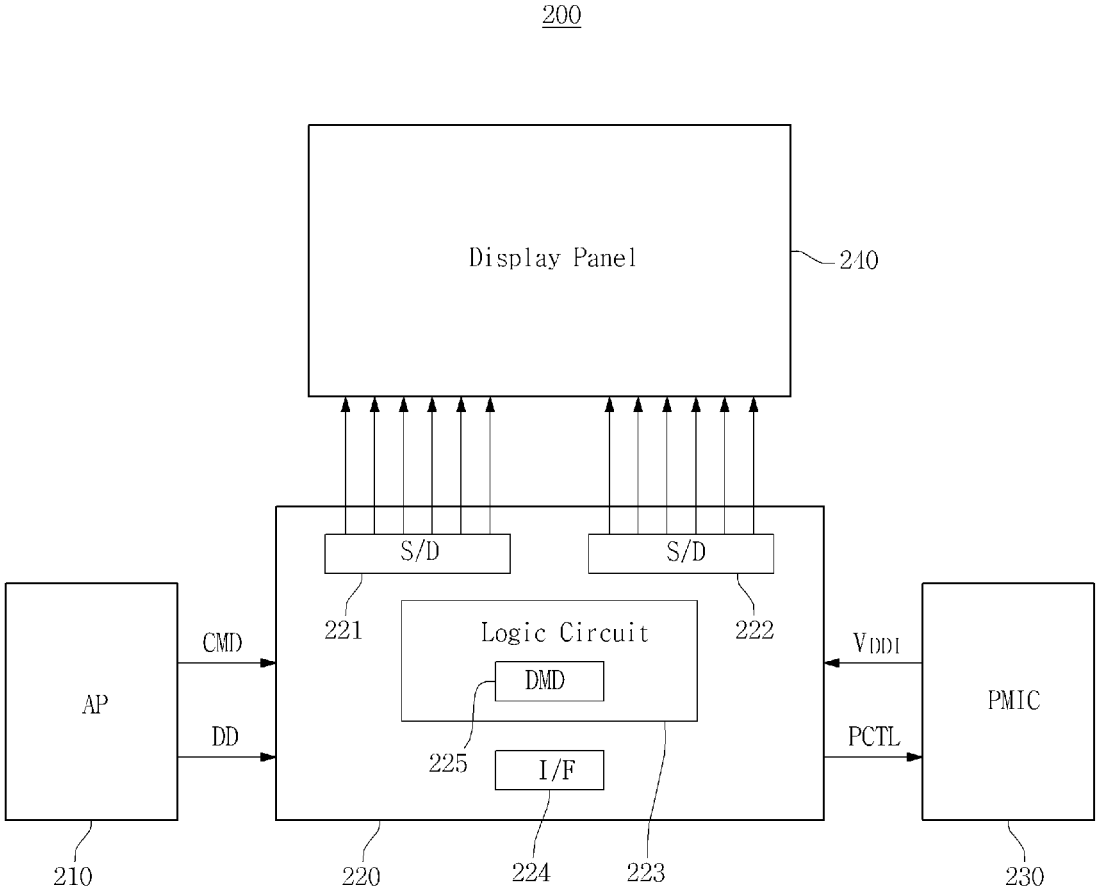
FIG. 4 is a block diagram illustrating a mobile device according to a second embodiment of the inventive concepts.

FIG. 4 is a block diagram illustrating a mobile device according to the second embodiment of the inventive concepts. Referring to FIG. 4, the mobile device according to the second embodiment of the inventive concepts 200 may include an AP 210, a DDI 220, a PMIC 230, and a display panel 240.

The AP 210 may transmit a command CMD and display data DD to the DDI 220. The command CMD may include information about a display mode. The display data DD may include data to be displayed in the display panel 240.

The DDI 220 according to the embodiment of the inventive concepts may include a plurality of source drivers 221 and 222, a logic circuit 223, and an interface circuit 224.

Each of the plurality of source drivers 221 and 222 may apply a grey voltage corresponding to the display data DD to the display panel 240. The display panel 240 may display an image corresponding to the display data DD.

The DDI 220 may change the display mode based on the command CMD. For example, the display mode may include a normal mode and an edge mode. In the normal mode, the display panel 240 may activate all areas of the display panel 240. In the edge mode, when the display panel 240 is divided into three parts in a width direction, the display panel may activate only both side areas of the display panel 240.

A current consumption of the DDI 220 in the edge mode may be less than a half of a current consumption of the DDI 220 in the normal mode.

The logic circuit 223 may include a display mode decision unit (DMD) 225 for analyzing the command CMD transmitted from the AP 110. To reduce a power consumption, the DMD 225 according to the embodiment of the inventive concepts may determine the display mode by analyzing the command CMD.

For example, the DMD 225 may determine the display mode. When the display mode is in a normal mode, the power consumption of the DDI 220 may be high. Accordingly, the logic circuit 223 may control the PMIC 230 to maintain a voltage level of the power voltage $V_{DDI}$ as it is.

On the other hand, the display data is in the edge mode for displaying only edge areas, the power consumption of the DDI 220 may be low. Accordingly, the logic circuit 223 may control the PMIC 230 to lower a voltage level of the power voltage $V_{DDI}$. That is, the logic circuit 223 may generate the PMIC control signal PCTL for controlling the power voltage $V_{DDI}$. The logic circuit 223 may transmit the PMIC control signal PCTL to the PMIC 230 through the interface circuit 224.

In response to the PMIC control signal PCTL, the PMIC 230 may supply the power voltage $V_{DDI}$ to the DDI 220. Therefore, a power consumption of the DDI according to the embodiment of the inventive concepts can be reduced.

Figure 5A:
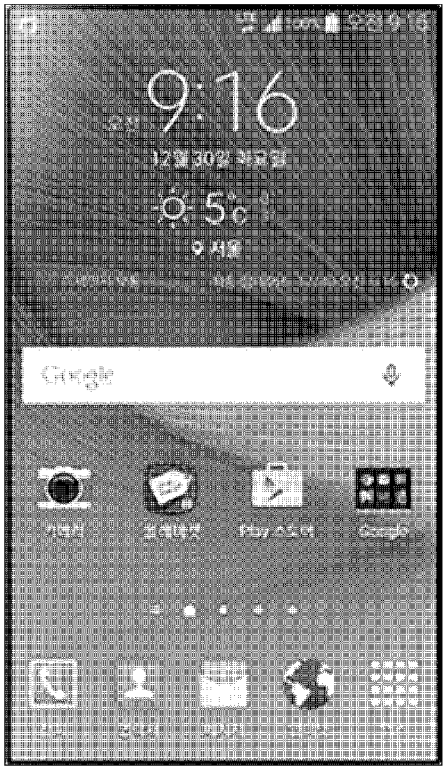
FIGS. 5A and 5B are images for describing the display mode.
Figure 5B:
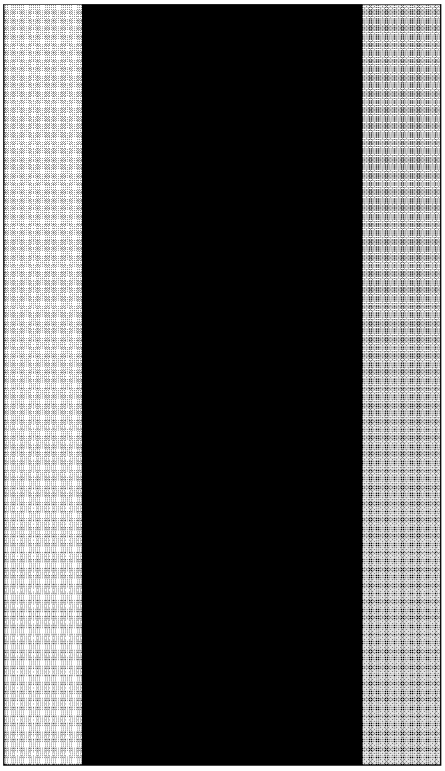

FIGS. 5A and 5B are images for describing the display mode. Referring to FIGS. 4 and 5A, the command CMD may include information about the display mode. In an embodiment, the display mode may include a normal mode for driving all areas in the display panel 240 and an edge mode for driving only edge areas in the display panel 240.

For example, when the command CMD includes the normal mode, the logic circuit 223 may control the PMIC 230 to maintain a voltage level of the power voltage $V_{DDI}$ as it is. The first image 51 may correspond to the normal mode.

Referring to FIGS. 4 and 5B, when the command CMD includes the edge mode, the logic circuit 223 may control the PMIC 230 to lower a voltage level of the power voltage $V_{DDI}$. The second image 52 may correspond to the edge mode.

Figure 6:
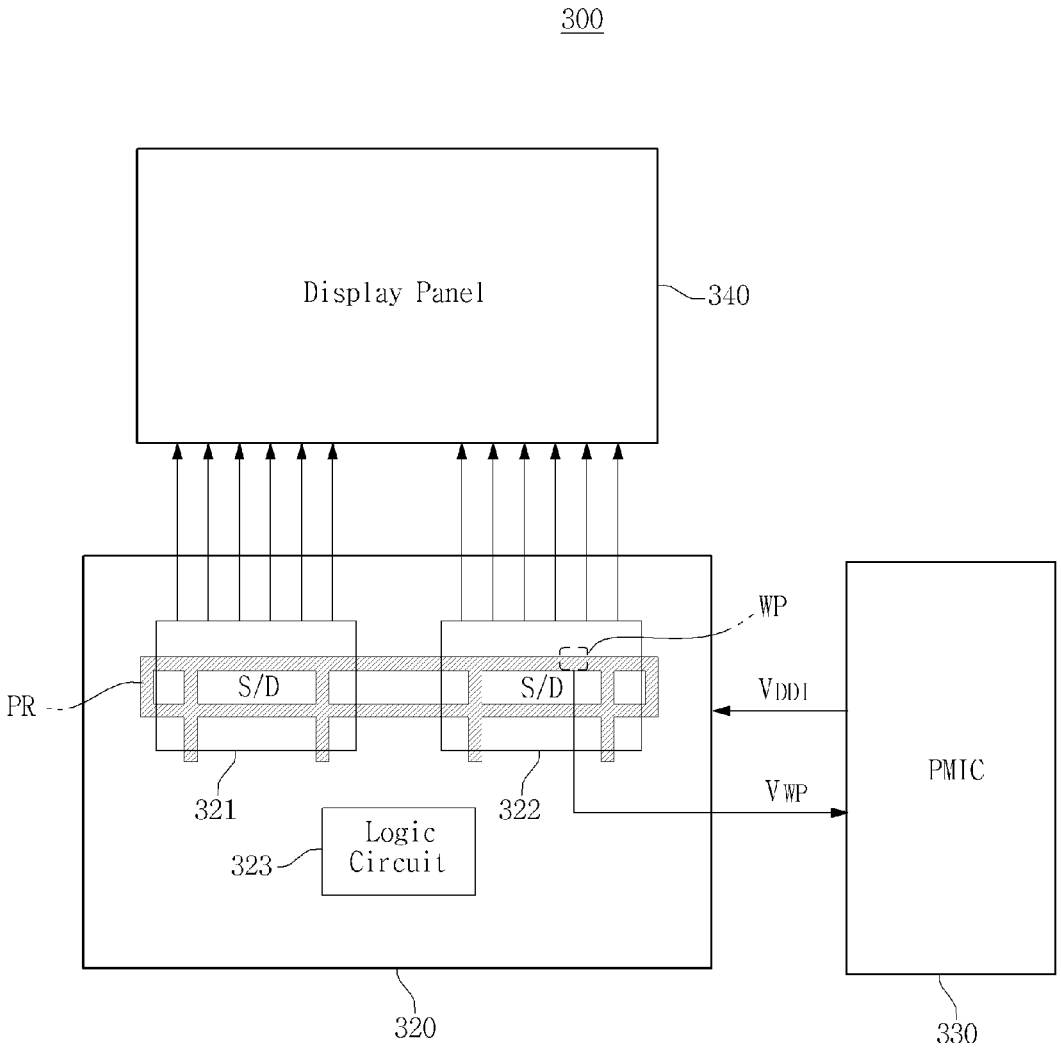
FIG. 6 is a block diagram illustrating a mobile device according to a third embodiment of the inventive concepts.

FIG. 6 is a block diagram illustrating a mobile device according to the third embodiment of the inventive concepts. Referring to FIG. 6, the mobile device 300 according to the third embodiment of the inventive concepts may include an AP 310, a MI 320, a PMIC 330, and a display panel 340.

The DDI 320 according to the embodiment of the inventive concepts may include a plurality of source drivers 321 and 322 and a logic circuit 323.

The logic circuit 323 may control each of the plurality of source drivers 321 and 322. Each of the plurality of source drivers 321 and 322 may include a resistor string and a plurality of amplifiers. The power voltage $V_{DDI}$ may be applied to each of the plurality of amplifiers. That is, the power voltage DDI may be applied to each of the plurality of amplifiers through a power routing PR. Here, a worst point WP may exist in one of the plurality of source drivers 321 and 322. The worst point WP may be a position at which a great voltage drop occurs due to a parasitic resistor and a parasitic capacitor generated due to the power routing PR. The position of the worst point WP may be determined through a simulation.

The PMIC 330 may include an analog feedback loop function for controlling an output voltage using an input voltage. The output voltage of the PMIC 330 may be controlled using the analog feedback loop function of the PMIC 330.

The voltage signal $V_{WP}$ of the worst point WP may be transmitted to the PMIC 330. The PMIC 330 may provide the power voltage $V_{DDI}$ corresponding to a voltage level $V_{WP}$ of the worst point WP to the plurality of source drivers 321 and 322. As a voltage corresponding to the worst point WP changes, the power voltage $V_{DDI}$ may be changed in real time. Therefore, a power consumption of the DDI 320 according to the embodiment of the inventive concepts can be reduced.

Figure 7:
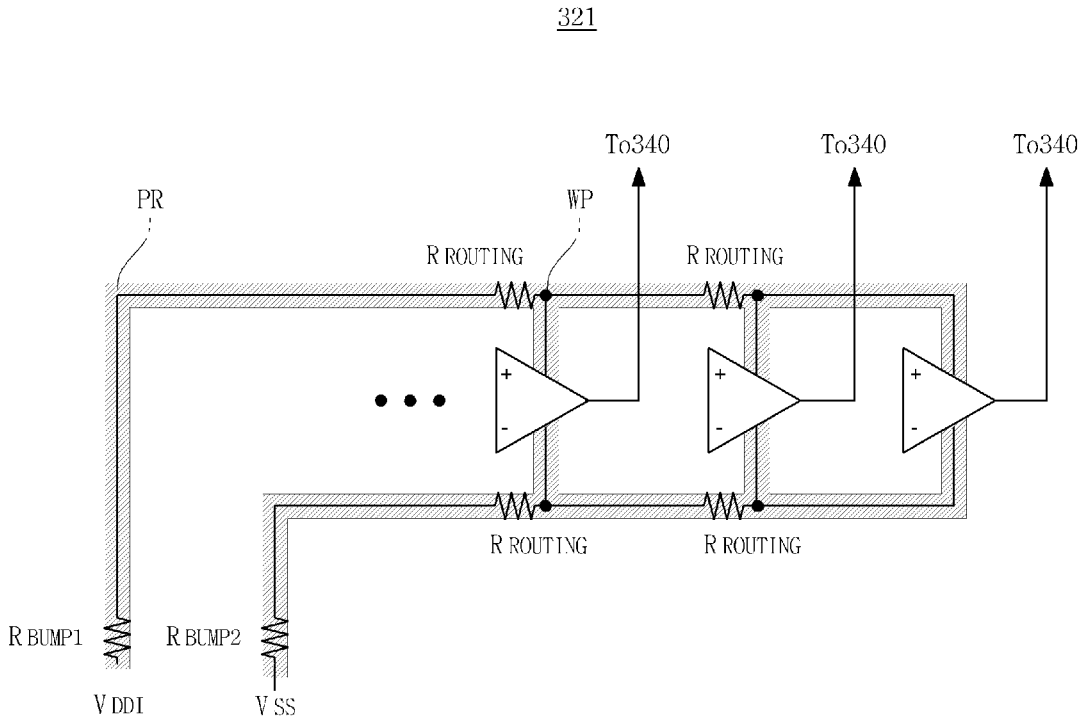
FIG. 7 is a circuit diagram illustrating a source driver shown in FIG. 6 in detail.

FIG. 7 is a circuit diagram illustrating a source driver shown in FIG. 6 in detail. Referring to FIGS. 6 and 7, each of the plurality of source drivers 321 and 322 may include a resistor string and a plurality of amplifiers. The resistor string may include a plurality of resistors having a resistance value $R_{ROUTING}$.

The power voltage $V_{DDI}$ may be applied to the resistor string through a first resistor $R_{BUMP1}$. Moreover, a ground voltage VSS may be applied to the resistor string through a second resistor $R_{BUMP2}$. The worst point WP may exist in the resistor string.

Each of the plurality of amplifiers may receive the power voltage $V_{DDI}$ and the ground voltage VSS through the resistor string. In one embodiment, the resistor string may be implemented with a power routing PR.

FIG. 7 may illustrate one source driver 321. However, the other source driver 322 may also include the same configuration as the one source driver 321.

Figure 8:
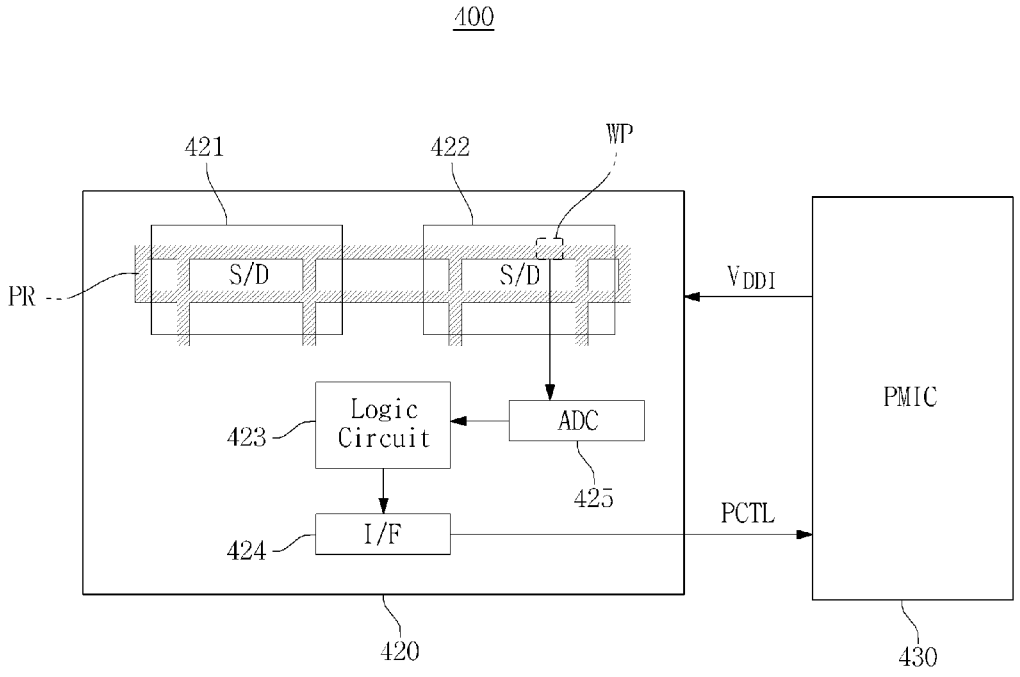
FIG. 8 is a block diagram illustrating a mobile device according to a fourth embodiment of the inventive concepts.

FIG. 8 is a block diagram illustrating a mobile device according to the fourth embodiment of the inventive concepts. Referring to FIG. 8, the mobile device 400 according to the fourth embodiment of the inventive concepts may include a DDI 420 and a PMIC 430.

The DDI 420 according to the embodiment of the inventive concepts may include a plurality of source drivers 421 and 422, a logic circuit 423, and an interface circuit 424.

As shown in FIG. 7, each of the plurality of source drivers 421 and 422 may include a resistor string and a plurality of amplifiers. The power voltage $V_{DDI}$ may be applied to each of the plurality of amplifiers. That is, the power voltage $V_{DDI}$ may be applied to each of the plurality of amplifiers through a power routing PR. Here, a worst point WP may exist in one of the plurality of source drivers 321 and 322. The worst point WP may be a position at which a great voltage drop occurs due to a parasitic resistor and a parasitic capacitor generated by the power routing PR. The position of the worst point WP may be determined through a simulation.

Further, the mobile device 400 according to the fourth embodiment of the inventive concepts may further include an ADC 425. A voltage signal of the worst point WP may be transmitted to the ADC 425.

The ADC 425 may change the voltage signal of the worst point WP into a digital signal. The 425 may transmit the changed digital value to the logic circuit 423.

The logic circuit 423 may transmit a PMIC control signal PCTL for controlling the power voltage $V_{DDI}$ corresponding to the digital value to the PMIC 430 through the interface circuit 424.

In response to the PMIC control signal PCTL, the PMIC 430 may transmit the power voltage $V_{DDI}$ corresponding to the digital value to the source drivers 421 and 422.

As a voltage corresponding to the worst point WP changes, the power voltage $V_{DDI}$ may be changed in real time. Accordingly, a total power consumption of the DDI 420 can be reduced.

Figure 9:
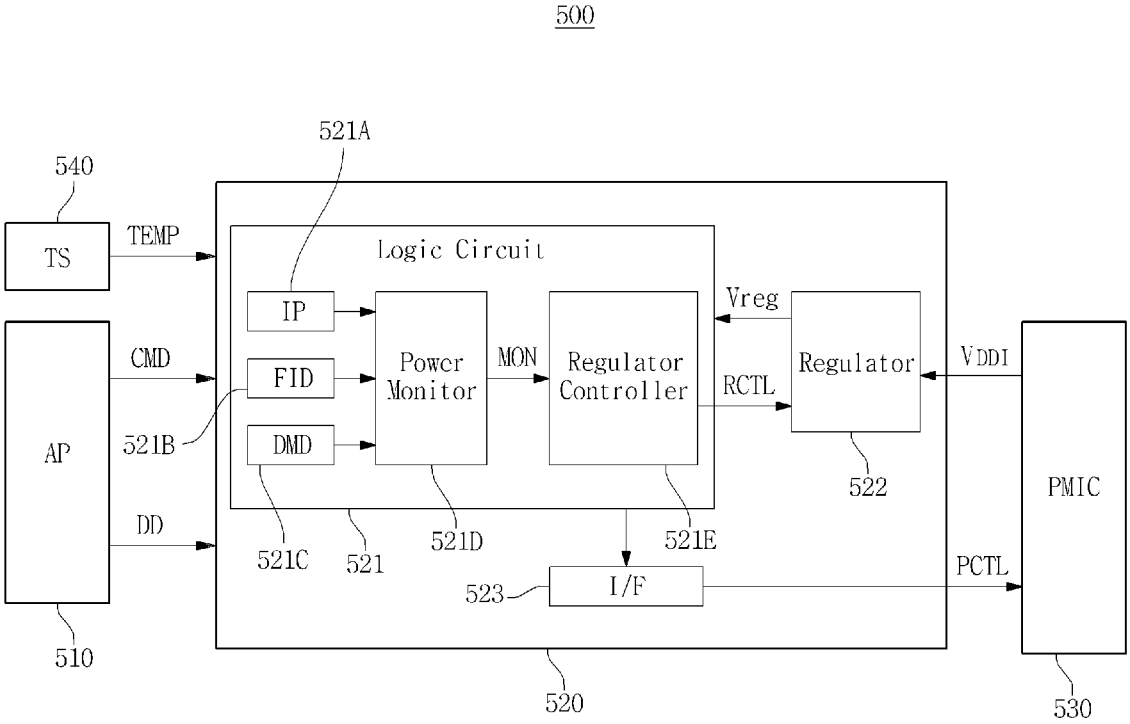
FIG. 9 is a block diagram illustrating a mobile device according to a fifth embodiment of the inventive concepts.

FIG. 9 is a block diagram illustrating a mobile device according to the fifth embodiment of the inventive concepts. Referring to FIG. 9, the mobile device 500 according to the fifth embodiment of the inventive concepts may include an AP 510, a DDI 520, a PMIC 530, and a temperature sensor 540.

The AP 510 may transmit a command CMD and display data DD to the DDI 520. The command CMD may include information about a display mode. The display data DD may include data to be displayed in the display panel. The DDI 520 according to the embodiment of the inventive concepts may include a logic circuit 521, a regulator 522, and an interface circuit 523. The logic circuit 521 may include an IP 521A, a FID 521B, a DMD 521C, a power monitor 521D, and a regulator controller 521E.

The IP 521A may include an image signal processor (ISP). The IP 521A may transmit information about IP on/off to the power monitor 521D.

As described with reference with FIG. 1, the FID 521B may receive the display data DD from the AP 510. The FID 512B may extract information about pixel toggle using the received display data DD. The FID 512B may transmit the information about the pixel toggle to the power monitor 521D.

For example, when the display data DD corresponding to all black colors, the current consumption may be reduced. Therefore, the regulator 522 may reduce the regulator voltage Vreg to reduce a current consumption of the DDI 520.

As described with reference with FIG. 4, the DMD 521C may receive the command CMD from the AP 510. The DMD 521C may extract information about the display mode using the received command CMD. The DMD 521C may transmit the information about the display mode to the power monitor 521D.

The power monitor 521D may predict a current consumption based on at least one of information about the pixel toggle, information about the display mode, information about the display mode, and temperature information TEMP. The regulator controller 521E may control the regulator 522 based on the predicted information from the power monitor 521D.

The logic circuit 521 may transmit a PMIC control signal PCTL for controlling the PMIC 530 to the PMIC 530 through the interface circuit 523. In response to the PMIC control signal PCTL, the PMIC 530 may provide the power voltage $V_{DDI}$ to the DDI 520. The regulator 522 may receive the power voltage $V_{DDI}$ and generate a regulator voltage Vreg.

Moreover, the temperature sensor 540 may transmit the temperature information TEMP to the DDI 520. The power monitor 521D may receive the temperature information TEMP.

The power monitor 521D may transmit a monitor signal MON corresponding to at least one of information about the pixel toggle, information about the display mode, information about the display mode, and temperature information TEMP to the regulator controller 521E. The regulator controller 521E may transmit a regulator control signal RCTL to the regulator 522 in response to the monitor signal MON.

The regulator 522 may control a regulator voltage Vreg in response to a regulator control signal RCTL. Accordingly, the DDI 520 can reduce the total power consumption.

Figure 10:
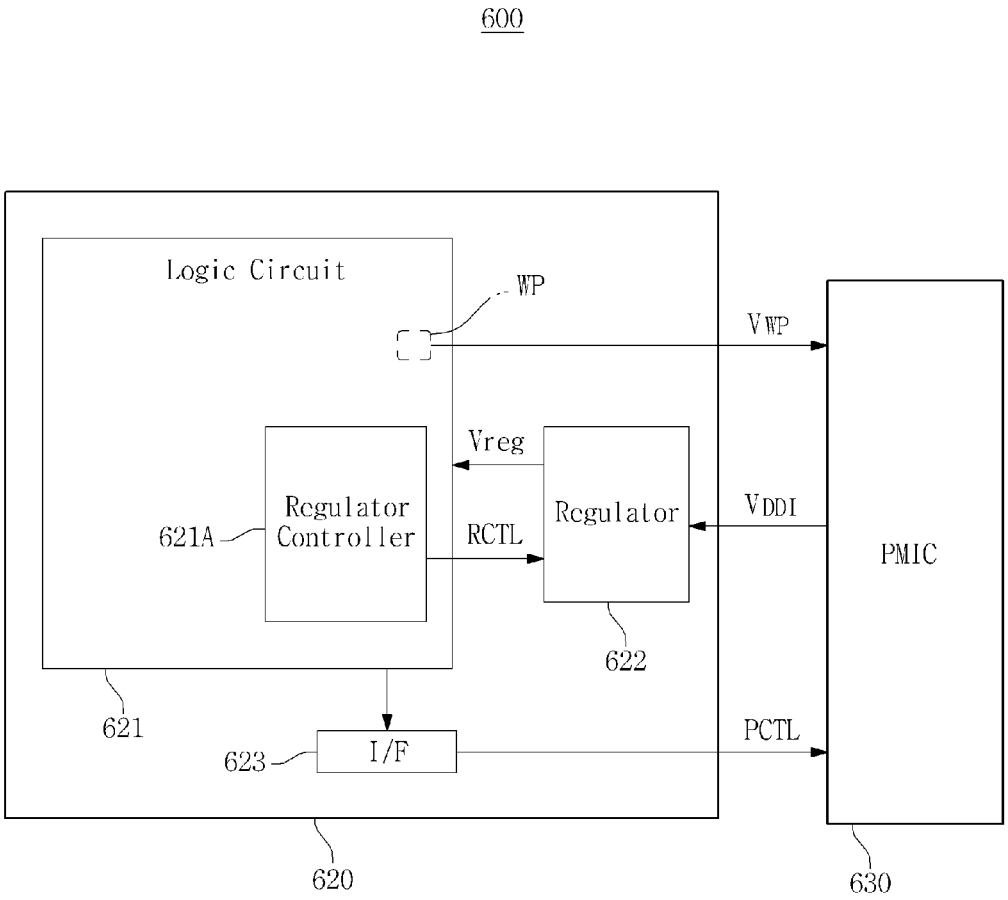
FIG. 10 is a block diagram illustrating a mobile device according to a sixth embodiment of the inventive concepts.

FIG. 10 is a block diagram illustrating a mobile device according to the sixth embodiment of the inventive concepts. Referring to FIG. 10, the mobile device 600 according to the sixth embodiment of the inventive concepts may include a DDI 620 and a PMIC 630.

The DDI 620 according to the embodiment of the inventive concepts may include a logic circuit 621, a regulator 622, and an interface circuit 623. In an embodiment, the logic circuit 621 may include a combination of a plurality of gates and a plurality of elements. The logic circuit 621 may include a worst point WP in the combination.

The worst point WP in the logic circuit 621 may be a position at which a great voltage drop occurs due to a parasitic resistor and a parasitic capacitor. The position of the worst point WP may be determined through a simulation.

The logic circuit 621 may further include a regulator controller 621A for controlling the regulator 622. The regulator controller 621A may generate a regulator control signal RCTL for controlling the regulator 622. The regulator controller 621A may transmit the regulator control signal RCTL to the regulator 622. In response to the regulator control signal RCTL, the regulator 622 may provide a regulator voltage Vreg to the logic circuit 621.

Further, the logic circuit 621 may generate a PMIC control signal PCTL for controlling the PMIC 630. The logic circuit 621 may transmit a PMIC control signal PCTL to the PMIC 630 through the interface circuit 623. In response to the PMIC control signal PCTL, the PMIC 630 may provide the power voltage $V_{DDI}$ to the DDI 620.

The PMIC 630 may include an analog feedback loop function for controlling an output voltage using an input voltage. The output voltage of the PMIC 630 may be controlled using the analog feedback loop function of the PMIC 630.

The voltage signal $V_{WP}$ of the worst point WP may be transmitted to the PMIC 630. The PMIC 630 may provide the power voltage $V_{DDI}$ corresponding to a voltage level $V_{WP}$ of the worst point WP to the regulator 622. As a voltage corresponding to the worst point WP changes, the power voltage $V_{DDI}$ may be changed in real time.

The regulator 622 may receive the power voltage $V_{DDI}$. The regulator 622 may control the regulator voltage Vreg in response to a change in the power voltage $V_{DDI}$. Therefore, a power consumption of the DDI 620 according to the embodiment of the inventive concepts can be reduced.

Figure 11:
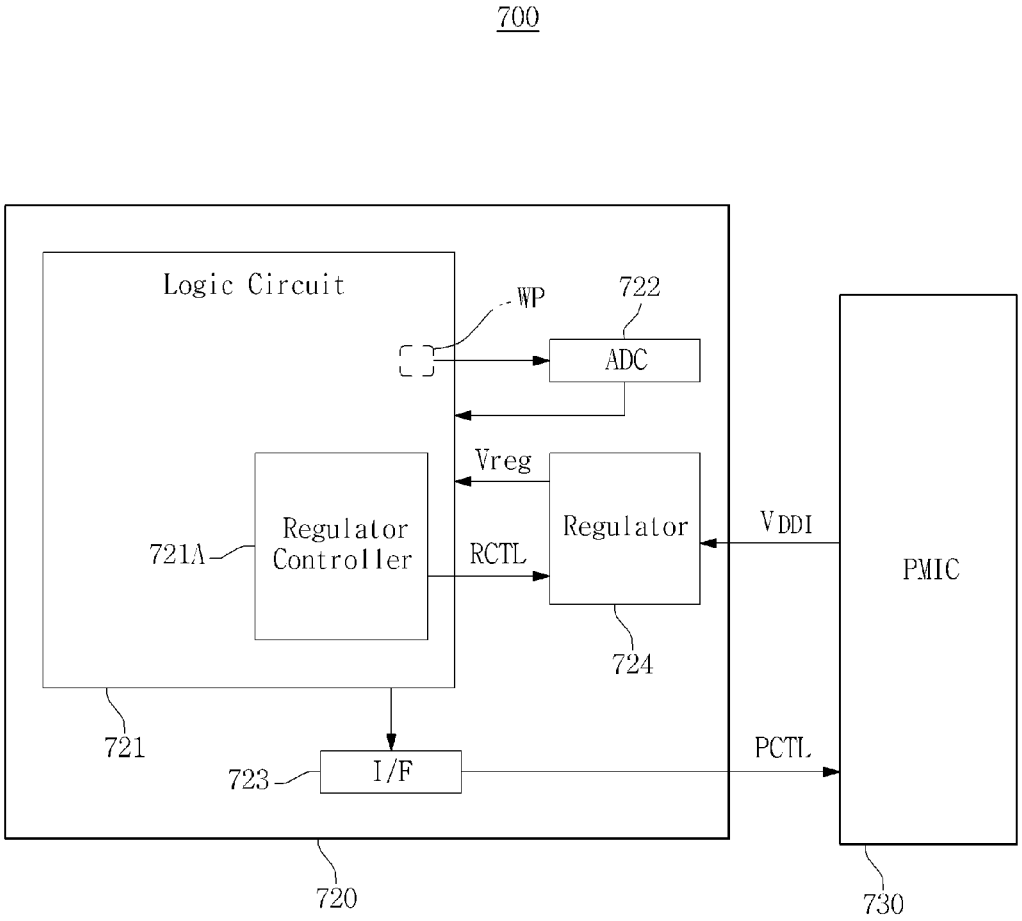
FIG. 11 is a block diagram illustrating a mobile device according to a seventh embodiment of the inventive concepts.

FIG. 11 is a block diagram illustrating a mobile device according to the seventh embodiment of the inventive concepts. Referring to FIG. 11, the mobile device 700 according to the seventh embodiment of the inventive concepts may include a DDI 720 and a PMIC 730.

The DDI 720 according to the embodiment of the inventive concepts may include a logic circuit 721, an ADC 722, an interface circuit 723, and a regulator 724. In an embodiment, the logic circuit 721 may include a combination of a plurality of gates and a plurality of elements. The logic circuit 721 may include a worst point WP in the combination.

The worst point WP in the logic circuit 721 may be a position at which a great voltage drop occurs due to a parasitic resistor and a parasitic capacitor. The position of the worst point WP may be determined through a simulation.

The logic circuit 721 may further include a regulator controller 721A for controlling the regulator 724. The regulator controller 721A may generate a regulator control signal RCTL for controlling the regulator 724. The regulator controller 721A may transmit the regulator control signal RCTL to the regulator 724. In response to the regulator control signal RCTL, the regulator 724 may provide a regulator voltage Vreg to the logic circuit 721.

The voltage signal $V_{WP}$ of the worst point WP may be transmitted to the ADC 722. The ADC 722 may convert the voltage signal of the worst point WP into a digital value. The ADC 722 may transmit the digital value to the logic circuit 721.

The logic circuit 721 may transmit the PMIC control signal PCTL for controlling the power voltage $V_{DDI}$ corresponding to the digital value to the PMIC 730 through the interface circuit 723. In response to the PMIC control signal PCTL, the PMIC 730 may transmit the power voltage $V_{DDI}$ corresponding to the digital value to the regulator 724. As a voltage corresponding to the worst point WP changes, the power voltage $V_{DDI}$ may be changed in real time.

The regulator 724 may receive the power voltage VDDI. The regulator 724 may control the regulator voltage Vreg in response to a change in the power voltage $V_{DDI}$. Therefore, a power consumption of the DDI 720 according to the embodiment of the inventive concepts can be reduced.

Figure 12:
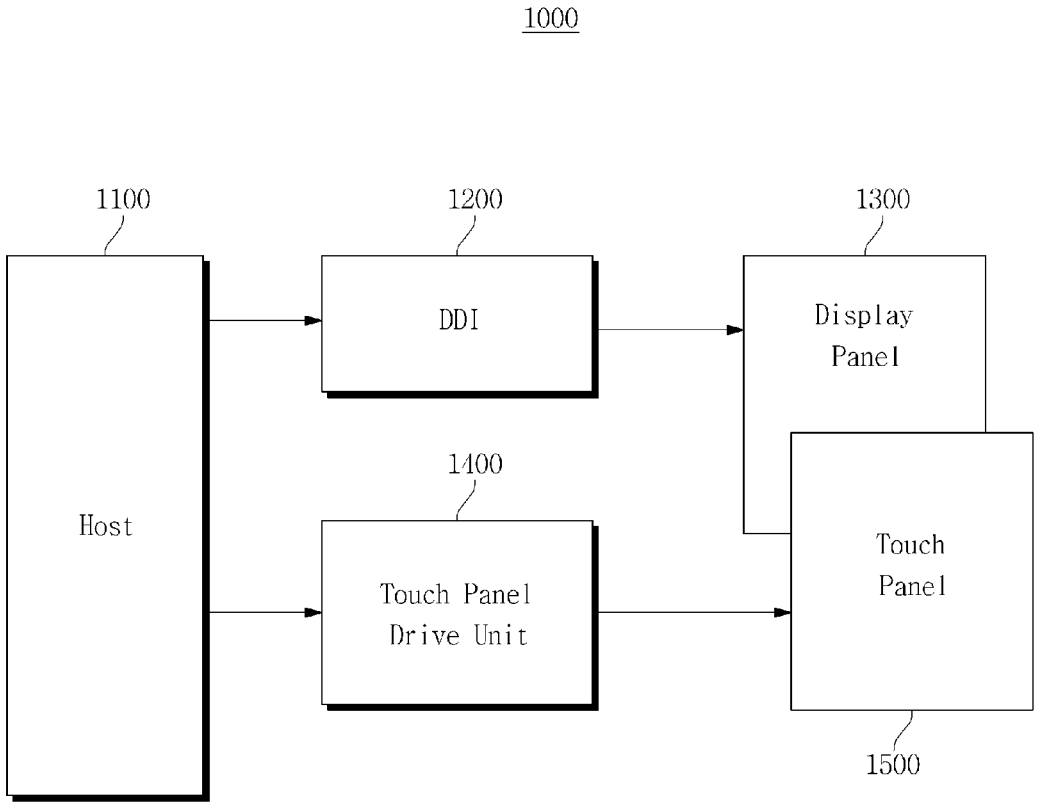
FIG. 12 is a block diagram exemplarily illustrating a user system to which the DDI according to an embodiment of the inventive concepts is applied.

FIG. 12 is a block diagram exemplarily illustrating a user system to which the DDI according to an embodiment of the inventive concepts is applied. Referring to FIG. 12, the user system 1000 may include a host 1100, a DDI 1200, a display panel 1300, a touch panel drive unit 1400, and a touch panel 1500.

The host 1100 may receive data or a command from a user, and may control the DDI 1200 and the touch panel drive unit 1400 based on the data or the command. The DDI 1200 may drive the display panel 1300 according to control of the host 1100. In an embodiment, the DDI 1200 may include the DDI 120 shown in FIG. 1.

The touch panel 1500 may be provided to overlap the display panel 1300. The touch panel drive unit 1400 may receive sensed data from the touch panel 1500 and transmit the sensed data to the host 1100.

Figure 13:
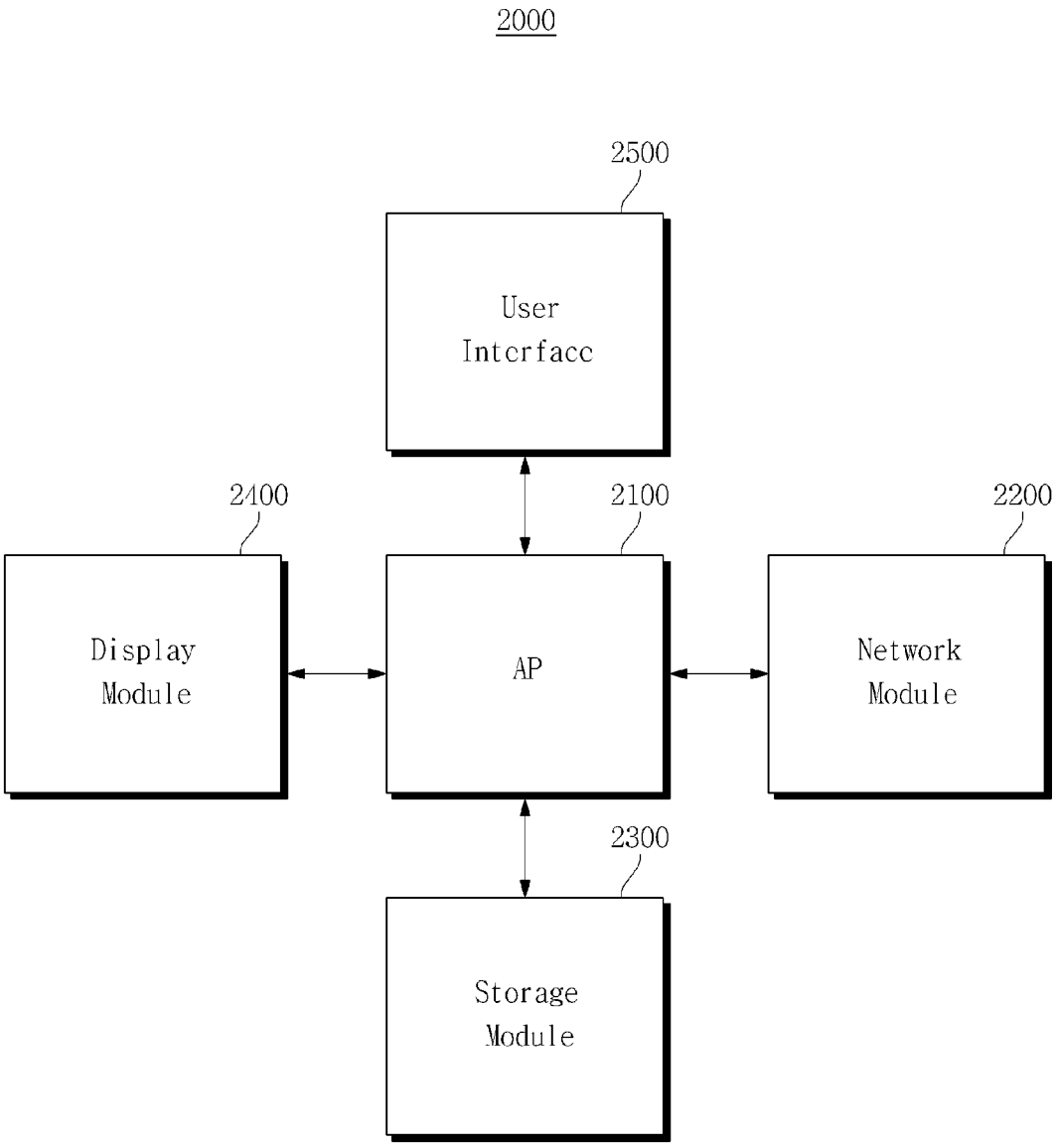
FIG. 13 is a block diagram exemplarily illustrating a mobile system to which the DDI according to an embodiment of the inventive concepts is applied.

FIG. 13 is a block diagram exemplarily illustrating mobile system to which the DDI according to an embodiment of the inventive concepts is applied. Referring to FIG. 13, the mobile system 2000 may include an AP 2100, a network module 2200, a storage module 2300, a display module 2400, and a user interface 2500.

For example, the mobile system 2000 may be provided with one of computing systems such as an ultra mobile personal computer (UMPC), a work-station, a net-book, a personal digital assistant (PDA), a portable computer, a web tablet, a wireless phone, a mobile phone, a smart phone, an e-book, a portable multimedia player (PMP), a portable game machine, a navigation device, a black box, a digital camera, a digital multimedia broadcasting (DMB) player, a digital audio recorder, a digital audio player, a digital picture player, a digital video recorder, a digital video player, etc.

The AP 2100 may operate components which are included in the mobile system 2000, an operating system (OS), etc. For example, the AP 2100 may include a graphic engine, controllers which control the components included in the mobile system 2000, and interfaces.

The network module 2200 may communicate with external devices. The network module 2200 may support a wireless communication such as a code division multiple access (CDMA), a global system for mobile communication (GSM), a wideband code division multiple access (WCDMA), a CDMA-2000, a time division multiple access (TDMA), a long term evolution (LIE), a WiMAX, a wireless local area network (WLAN), an ultra wide band (UWB), a Bluetooth, a wireless display (WI-DI), etc.

The storage module 2300 may store data. For example, the storage module 2300 may store data received from an external device. Moreover, the storage module 2300 may transmit data stored in the storage module 2300 to the AP 2100. In an embodiment, the storage module 2300 may include a dynamic random access memory (DRAM), a synchronous DRAM (SDRAM), a static RAM (SRAM), a double date rate SDRAM (DDR SDRAM), a DDR2 SDRAM, a DDR3 SDRAM, a phase-change RAM (PRAM), a magnetic RAM (MRAM), a Resistive RAM (RRAM), a NAND flash memory, and a NOR flash memory.

The display module 2400 may output image data according to control of the AP 2100. For example, the display module 2400 and the AP 2100 may communicate with each other based on a display serial interface (DSI). In an embodiment, the display module 2400 may include the DDI 100 shown in FIG. 2.

The user interface 2500 may supply an interface, which inputs data or a command to the mobile system 2000 or outputs results based on the input data or the input command. In an embodiment, the user interface 2500 may include input devices such as a camera device, a touch screen, a motion perceive module, and a microphone and output devices such as a speaker, and a display panel.

The DDI according to the embodiment of the inventive concepts may control a PMIC to change a supply voltage by predicting or measuring an amount of current consumption. Accordingly, the DDI can reduce a current consumption.

The inventive concepts may be applied to a DDI and a display apparatus having the same.

While the inventive concepts has been described with reference to example embodiments, it will be understood by those skilled in the art that various changes and modifications may be made without departing from the spirit and scope of the present disclosure as defined by the appended claims.

Although a few embodiments have been described, those skilled in the art will readily appreciate that many modifications are possible without materially departing from the novel teachings and advantages. Accordingly, all such modifications are intended to be included within the scope of this inventive concepts as defined in the claims.

What is claimed is:

1. A display driver integrated circuit comprising:

a source driver configured to receive a power voltage from a power management integrated circuit; and a logic circuit configured to receive display data from an application processor, to perform an analysis on the display data, and to control a voltage level of the power management integrated circuit based on the analysis, wherein the logic circuit is configured to set the voltage level of the power management integrated circuit to one of at least three different voltages by comparing the analysis with a first reference value and a second reference value, wherein the display data comprises image data in units of frames, the image data in units of frames comprises a plurality of horizontal lines, each of the plurality of horizontal lines includes a plurality of pixel bits, and the logic circuit is configured to control the power management integrated circuit by comparing each pixel bit of a first horizontal line with each pixel bit of a second horizontal line adjacent to the first horizontal line, summing compared results, and controlling the voltage level of the power voltage based on a summed result, wherein the first horizontal line and the second horizontal line extend a length of the image data.

2. The display driver integrated circuit of claim 1, wherein the logic circuit is configured to control the power management integrated circuit to lower the voltage level of the power voltage when the summed result is less than the first reference value, and the logic circuit controls the power management integrated circuit to maintain the voltage level of the power voltage when the summed result is greater than or equal to the first reference value and less than or equal to the second reference value.

3. The display driver integrated circuit of claim 1, wherein the logic circuit is configured to extract information about a display mode from a command and predict an amount of current consumption according to the display mode.

4. The display driver integrated circuit of claim 3, wherein the display mode includes a first mode configured to drive an entire area of a display panel and a second mode configured to drive a portion of the display panel.

5. The display driver integrated circuit of claim 4, wherein the logic circuit is configured to control the power management integrated circuit to maintain the voltage level of the power voltage when the command includes the first mode.

6. The display driver integrated circuit of claim 4, wherein the logic circuit is configured to control the power management integrated circuit to lower the voltage level of the power voltage when the command includes the second mode.

7. The display driver integrated circuit of claim 4, wherein the second mode includes a mode for driving only an edge area of the display panel.

8. The display driver integrated circuit of claim 1, further comprising:

an interface circuit, wherein the logic circuit is configured to transmit a control signal to the power management integrated circuit through the interface circuit.

9. The display driver integrated circuit of claim 1, wherein the comparing each pixel bit of a first horizontal line with each pixel bit of a second horizontal adjacent to the first horizontal line includes, performing an XOR operation on the a first pixel bit of the first horizontal line and a second pixel bit of the second horizontal line.

* * * * *